US008496039B1

(12) United States Patent
Barresi

(10) Patent No.: US 8,496,039 B1
(45) Date of Patent: Jul. 30, 2013

(54) PORTABLE OPERATIONAL PRIVACY PRESS ON GLASS-COVER BLIND FOR DOORS WITH GLASS AND WINDOWS

(76) Inventor: Vincenza Barresi, Medford, NY (US)

( * ) Notice: Subject to any disclaimer, the term of this patent is extended or adjusted under 35 U.S.C. 154(b) by 714 days.

(21) Appl. No.: 11/624,118

(22) Filed: Jan. 17, 2007

(51) Int. Cl.
*E06B 7/00* (2006.01)

(52) U.S. Cl.
USPC ..... 160/107; 49/87.1; 49/64

(58) Field of Classification Search
USPC ..... 49/73.1, 74.1, 87.1, 57, 463, 62, 49/63, 64, 65; 52/202, 203; 160/32–34, 182, 160/215, 107
See application file for complete search history.

(56) References Cited

U.S. PATENT DOCUMENTS

| | | | | |
|---|---|---|---|---|
| 272,914 | A | 2/1883 | Soule | |
| 729,599 | A * | 6/1903 | Jolly | 40/505 |
| 1,701,695 | A | 2/1929 | Paine | |
| 2,565,979 | A | 8/1951 | Michaelsen | |
| 3,451,165 | A | 6/1969 | O'Hair | |
| 4,758,042 | A * | 7/1988 | Liu | 296/97.7 |
| 4,932,710 | A * | 6/1990 | Chen | 296/97.3 |
| 4,944,548 | A * | 7/1990 | Payne et al. | 296/97.8 |
| 4,951,909 | A * | 8/1990 | Russo et al. | 248/206.2 |
| 5,207,258 | A * | 5/1993 | Lennard | 160/130 |
| 5,226,466 | A * | 7/1993 | Coddens | 160/107 |
| 5,282,504 | A * | 2/1994 | Anderson et al. | 160/107 |
| 5,495,884 | A * | 3/1996 | Shikler | 160/120 |
| 5,608,990 | A | 3/1997 | Kyle | |
| 5,787,956 | A * | 8/1998 | Chen | 160/370.23 |
| 5,813,450 | A | 9/1998 | Yang | |
| 5,823,241 | A * | 10/1998 | Sitzes et al. | 160/107 |
| 6,062,291 | A * | 5/2000 | Morgan et al. | 160/176.1 R |
| 6,244,778 | B1 * | 6/2001 | Chesbrough | 403/51 |
| 6,257,301 | B1 * | 7/2001 | Conforti | 160/84.07 |
| 6,308,923 | B1 * | 10/2001 | Howard | 248/205.5 |
| 6,516,857 | B1 * | 2/2003 | Gajtka et al. | 160/107 |
| 6,550,735 | B1 * | 4/2003 | Zheng | 248/304 |
| 6,837,003 | B2 | 1/2005 | Nien | |
| 2005/0252088 | A1 * | 11/2005 | Hsu | 49/92.1 |

FOREIGN PATENT DOCUMENTS

| | | |
|---|---|---|
| CA | 2.329.630 | 6/2001 |
| GB | 2.393.994 | 4/2004 |
| WO | WO2006/002184 | 1/2006 |

* cited by examiner

*Primary Examiner* — Katherine Mitchell
*Assistant Examiner* — Daniel Cahn
(74) *Attorney, Agent, or Firm* — Michael I. Kroll

(57) ABSTRACT

A portable operational privacy pressed on glass-cover blind for doors with oval shape glass and windows that can be mounted to any door or window by means of releasable fasteners mounted on the back side of the privacy screen. The blind-slats can be oriented in either a horizontal or vertical position having the operating-rod perpendicularly mounted to the blind-slats. Additionally, the present invention provides for a privacy screen having a frame with a plurality of fabric slats extending longitudinally across the privacy screen frame without the need of tools, drilling, holes, nails, etc.

3 Claims, 25 Drawing Sheets

PORTABLE OPERATIONAL PRIVACY PRESS ON GLASS-COVER BLIND FOR DOORS WITH GLASS AND WINDOWS

BACKGROUND OF THE INVENTION

1. Field of the Invention

The present invention relates generally to glass in doors and windows and, more specifically, to a portable operational privacy glass-cover blind that is mounted onto the glass of any shape door or window without the necessity of putting holes, or drilling, nails, etc. into walls, doors and windows.

The glass cover blind is made in a frame that has the same dimensions as the glass being covered and is then easily pressed and mounted on the glass within the existing door window frame. The glass-cover blind has a group of chosen fasteners either suction cups, double faced tape, clips, Velcro® and magnets whereby the glass-cover blind can be dismounted as desired for maintenance, painting, cleaning, repositioning, etc.

The present invention also provides that the portable operational privacy press on glass-cover blind-slats can be oriented in either a horizontal or vertical position having the operating-rod perpendicularly mounted to the blind-slats.

Additionally, the present invention provides for a glass-cover blind having a partial frame with a plurality of fabric slats extending longitudinally across the glass-cover blind frame which may include a drawstring to raise and lower the fabric slats.

2. Description of the Prior Art

There are other louvered devices designed for windows. Typical of these is U.S. Pat. No. 272,914 issued to Soule on Feb. 27, 1883.

Another patent was issued to Paine on Feb. 12, 1929 as U.S. Pat. No. 1,701,695. Yet another U.S. Pat. No. 2,565,979 was issued to Michaelsen on Aug. 28, 1951 and still yet another was issued on Jun. 24, 1969 to O'Hair as U.S. Pat. No. 3,451,165.

Another patent was issued to Kyle on Mar. 11, 1997 as U.S. Pat. No. 5,608,990. Yet another U.S. Pat. No. 5,813,450 was issued to Yang on Sep. 29, 1998. Another was issued to Nien on Jan. 4, 2005 as U.S. Pat. No. 6,837,003 and still yet another was issued on Jun. 30, 2001 to Van Hee as Canadian Patent No. CA 2 329 630.

Another patent was issued to Nien on Apr. 14, 2004 as U.K. Patent No. GB 2 393 994 and still yet another was published on Jan. 5, 2006 to Trey as International Patent Application No. WO 2006/002184.

U.S. Pat. No. 272,914

Inventor: George W. Soule

Issued: Feb. 27, 1883

The invention relates to an improvement in blind-slat wires and the manner of connecting the blind-slat to the operating-rods, the object of the same being to provide devices that can be secured to the operating-rod and blind-slat and securely hold them together without danger of splitting either the slat or rod.

U.S. Pat. No. 1,701,695

Inventor: Willis C. Paine

Issued: Feb. 12, 1929

A window blind construction wherein the pintles of the slats will operate freely at all times, eliminating any possibility of the pintles sticking as to prevent the operation of the slats comprising side bars, said side bars having grooves formed therein and extended throughout the lengths of the side bars, elongated plates having offset flanges formed along their edges and disposed throughout the lengths of the side bars, said plates having openings arranged in spaced relation with each other and disposed opposite to the grooves to accommodate pintles of slats of the blind.

U.S. Pat. No. 2,565,979

Inventor: Harry P. Michaelsen

Issued: Aug. 28, 1951

Remotely controlled venetian blind for automobile rear windows comprising a vertical frame member, a plurality of laterally extending slats each provided with a bracket having its outer end pivotally connected to said frame member, said slats normally abutting said frame member to normally lie in a horizontal plane. A vertically extending rod pivotally connected to the outer ends of the slats, and means for moving the rod upwardly whereby to place the slats in substantially vertical planes, said means including a piston for actuating the rod and a cylinder for actuating the piston.

U.S. Pat. No. 3,451,165

Inventor: Roy J. O'Hair

Issued: Jun. 24, 1969

A shutter frame which will accommodate a wide variety of interchangeable decorative insert panels, one of which contains a series of horizontally pivoted, tiltable louvers, comprising: a generally rectangular shutter frame having two side stiles with vertical slots formed along the inner edges, the side stiles being joined with top and bottom rails; a compressible element disposed in at least one vertical slot; two louver retaining strips having equally spaced holes along their inner edges and with their outer edges disposed in said slots, at least one of said two louver retaining strips engaging said compressible element; horizontally tillable louvers having a tenon extending from each end and inserted into selected holes on the inner edges of the louver retaining strips, whereby said louvers may be independently removable from the frame; a tilt rod linked to said louvers to control the angular orientation of the louvers.

U.S. Pat. No. 5,608,990

Inventor: James H. Kyle

Issued: Mar. 11, 1997

A removable light controlling blind assembly for a marine vessel or the like includes two generally circular superimposed panels. Each of those panels has a plurality of translucent horizontal strips printed thereon and a plurality of alternating light transmitting strips separating the translucent strips. The two panels are movable in a linear direction to bring the strips into registration with one another. A flexible gasket is also provided and includes a groove for positioning the blind assembly in a port or hatch in the vessel.

U.S. Pat. No. 5,813,450

Inventor: Ming-Shun Yang

Issued: Sep. 29, 1998

Disclosed is a sunshade for car back window for mounting on a deck extending between the back window and a back seat of a car and mainly including two independent but laterally symmetrical folding blinds and a mounting mechanism for locating the two folding blinds at a desired position. The mounting mechanism includes a base, a compression spring, a supporting seat, a rectangular pipe, an adjusting nut, a top cover, and two fragrant cakes. The base has an upwardly projected threaded stem which extends through the compression spring and the supporting seat into the adjusting nut such that the compression spring and the supporting seat are assembled to the base to form an integral unit. Turning the adjusting nut changes the height of the supporting seat relative to the base, prevent the sunshade from striking articles on the mounting deck. The supporting seat has two symmetrical compartments for accommodating the two fragrant cakes and a long recess between the two compartments for supporting the rectangular pipe. With these arrangements, the sunshade can block sunshine shining on the back window while providing fragrance to the car.

U.S. Pat. No. 6,837,003

Inventor: Ming Nien

Issued: Jan. 4, 2005

A wooden shutter. The wood shutter is installed on the wall around a window and includes an outer frame having a receiving open space and top and mounting portions at top and bottom ends of one side thereof. Louvers are arranged in parallel in the receiving open space within the outer frame. A first coupling unit and a second coupling unit are fixedly fastened to the wall around the window respectively. The first coupling unit has a fixed pivot pivoted to the bottom mounting portion of the outer frame. The second coupling unit has a movable pivot member detachably inserted through a through hole thereof for detachably pivoting to the top mounting portion of the outer frame for enabling the outer frame to be turned about the fixed pivot member and the movable pivot member in and out of the window.

Canadian Patent Number CA 2 329 630

Inventor: Michelle C. Van Hee

Issued: Jun. 30, 2001

At least one rigid shutter frame is pivotally mountable to a window frame on the inside of a dwelling. The shutter may be pivoted from a closed position covering the window to an open position which may be generally parallel to a portion of the wall of a dwelling adjacent to the window frame. The shutter has at least one light transmitting aperture formed therethrough, the edges of which are not parallel to the edges of the shutter frame but are decoratively formed in outline within the light transmitting aperture of the frame. The shutter frame, in co-operation with its light transmitting aperture formed therethrough, may be a bi-fold shutter. The shutter frame may be decorated, separately or in combination, with a backdrop of light diffusing fabric sheer curtains sandwiching light inhibiting curtains between the sheer curtains and the frame. The sandwiched curtains may be centrally gathered or may be colorful murals made from translucent fabric panels or may be slats.

U.K. Patent Number GB 2 393 994

Inventor: Ming Nien

Issued: Apr. 14, 2004

A wooden shutter 100 installed on a wall around a window, the shutter comprises a frame 11, 12, 13, 14 containing louvers 20. A bottom mounting portion 16 on the bottom side of the frame has a first coupling unit 40 which comprises a mounting plate 41 fixedly fastened to the wall and a fixed pivot member 42 fixedly located on the mounting plate and pivoted to the mounting portion on bottom of the frame. A mounting portion 15 on the top side of the frame has a second coupling unit 50 attached, which comprises a mounting plate 51 fixed to the wall and a movable pivot member 52 detachably installed in the mounting plate providing a pivot to the top of the frame. This enables the frame to be turned towards and away from the window (FIG. 5). Preferably, the detachable pivot member 52 is a round pivot pin which may be inserted through the hole 514 of the mounting plate of the second coupling unit.

International Patent Application Number WO 2006/002184

Inventor: Brant O'Hair Trey

Published: Jan. 5, 2006

A shutter panel apparatus having a shutter frame with a pair of stiles, spaced apart and generally parallel to one another, and a bottom rail and a top rail, each connected to the stiles. A plurality of generally parallel louvers are rotatably connected to the shutter frame such that each louver is rotatable along a longitudinal axis. The top rail is non-linear in shape and has a back face and a front face, the back face of the top rail having a recess therein for receiving the first end of an upper louver, the first end of the upper louver rotatably connected to the top rail. The invention has several embodiments and allows for the rotation of an upper louver or louvers where the top rail is arched, semi-circular or elliptical. The invention further allows for rotation of an upper louver or louvers where the shutter frame is circular, hexagonal or the like, and where the top rail is angled with respect to the stiles. Ideally, the invention allows the upper louvers to rotate through the same degree of rotation as the other louvers. The end of the upper louver has a notch which cooperates with the recess in the frame to allow rotation of the upper louver which could not be realized without the recess and notch. The notch can take more than one particular shape to cooperate with the recess.

While these louvered devices may be suitable for the purposes for which they were designed, they would not be as suitable for the purposes of the present invention, as hereinafter described.

SUMMARY OF THE PRESENT INVENTION

A primary object of the present invention is to provide a portable operational privacy press on glass-cover blind that is easily installed and removed for maintenance, painting, repositioning, etc., without the use of tools.

Another object of the present invention is to provide a portable operational privacy press on glass-cover blind having one or more fasteners taken from the group of suction cups, double faced tape, clips, Velcro® and magnets.

Still yet another object of the present invention is to provide a glass-cover blind having a top and bottom suction cup whereby the glass-cover blind can be selectively mounted to the glass on door or window, without the need of drilling holes, using nails or tools, etc. This portable glass-cover blind is just pressed onto the glass window of any shape or design and is easily removed for maintenance, painting, re-positioning Another object of the present invention is to provide a glass-cover blind wherein the blind-slats are fabric without an operating-rod.

Additional objects of the present invention will appear as the description proceeds.

The present invention overcomes the shortcomings of the prior art by providing a portable operational louvered privacy press on cover blind that can be mounted to any glass on a door or window by means of releasable fasteners mounted on the back side of the privacy screen. The blind-slats can be oriented in either a horizontal or vertical position having the operating-rod perpendicularly mounted to the blind-slats. Additionally, the present invention provides for a privacy screen having a frame with a plurality of fabric slats extending longitudinally across the privacy screen frame.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
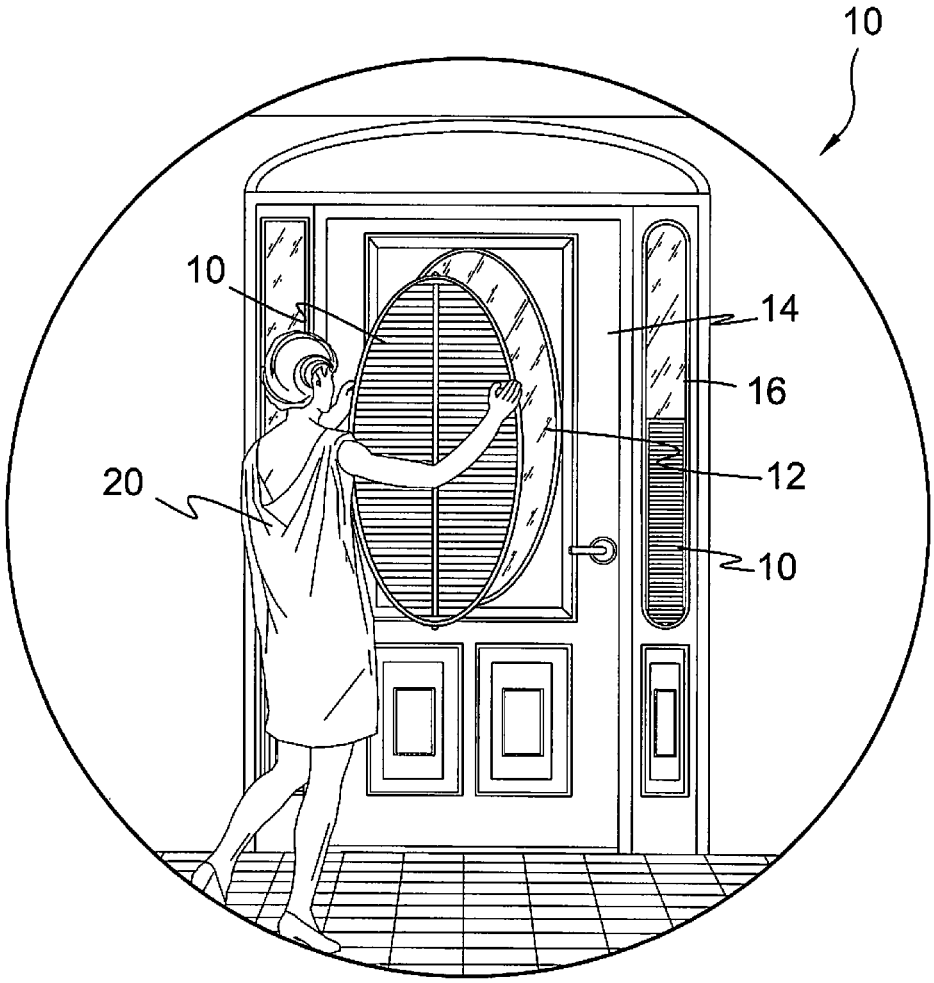
FIG. 1 is an illustrative view of the portable operational privacy press on glass-cover blind.

Turning now descriptively to the drawings, in which similar reference characters denote similar elements throughout the several views, the figures illustrate the Glass Cover Blind of the present invention. With regard to the reference numerals used, the following numbering is used throughout the various drawing figures.

10 Glass Cover Blind of the present invention
12 glass
14 door
16 window
18 frame of 10
20 user
22 slats
24 releasable fastener
26 operating rod
28 drawstring
30 suction cup
32 hook and loop fastening element
34 magnet
36 double sided tape
38 casement window
40 double hung window
42 attachment means of 26
44 slat pivot
46 frame housing
50 pivoting handle
52 clip
54 bottom window of 40

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the portable privacy glass-cover blind 10. The present invention is a portable operational privacy glass-cover that is mounted by pressing onto the glass of any shape glass 12 on doors 14 and windows 16 without the necessity of putting holes, or drilling, nails, etc. into walls, doors 14 and windows 16. The glass-cover blind 10 is made in a frame 18 that has the same dimensions as the glass 12 being covered and is then easily pressed and mounted on the glass 12 within the existing door window-frame. The glass-cover blind 10 has a group of chosen fasteners either suction cups, double faced tape, clips, Velcro® and magnets whereby the glass-cover blind 12 can be dismounted as desired for maintenance, painting, cleaning, re-positioning, etc.

Figure 2:
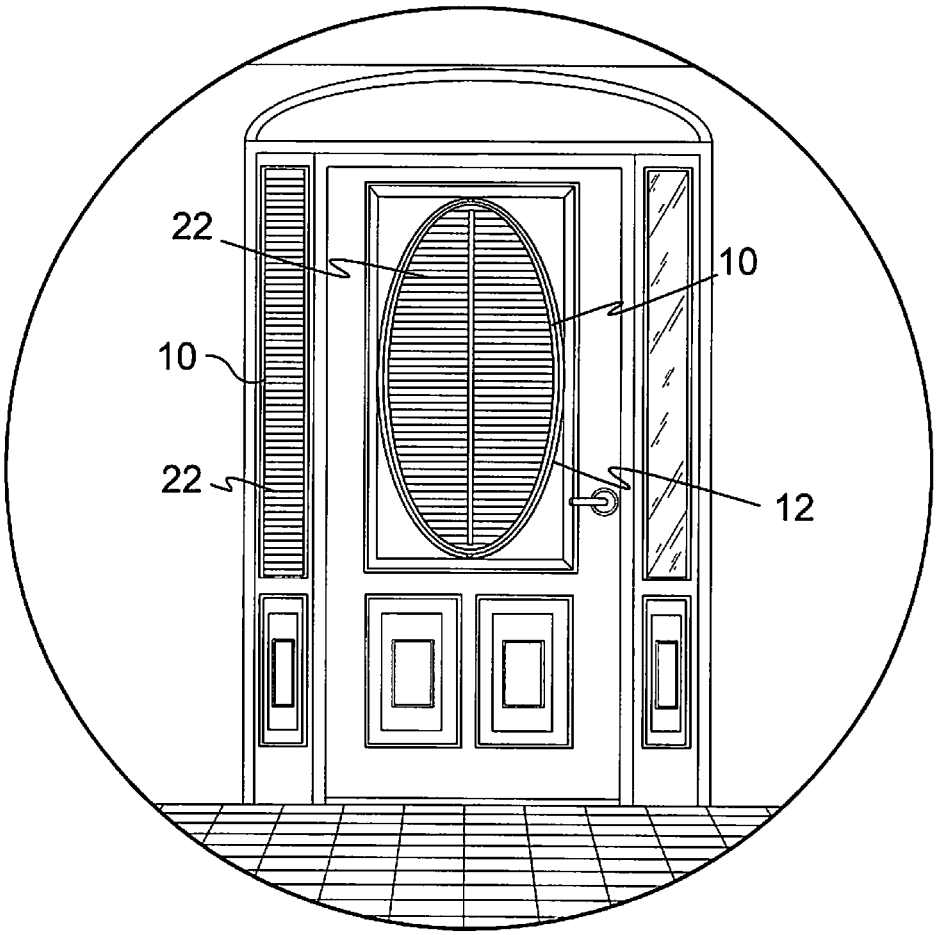
FIG. 2 is an illustrative view of the portable operational privacy cover blind pressed on glass, in use.

FIG. 2 is an illustrative view of the portable operational privacy cover blind 10 pressed on glass, in use. As illustrated, the glass-cover blind 10 has a plurality of slats 22 movable between and open and closed position with the glass-cover blind 10 substantially encompassing the door-glass 12 window member. The glass-cover blind 10 uses fasteners to releasably fix the glass-cover blind 10 to the window or window frame so that a user can easily remove the glass-cover blind 10 as desired for maintenance, painting and re-positioning.

Figure 3:
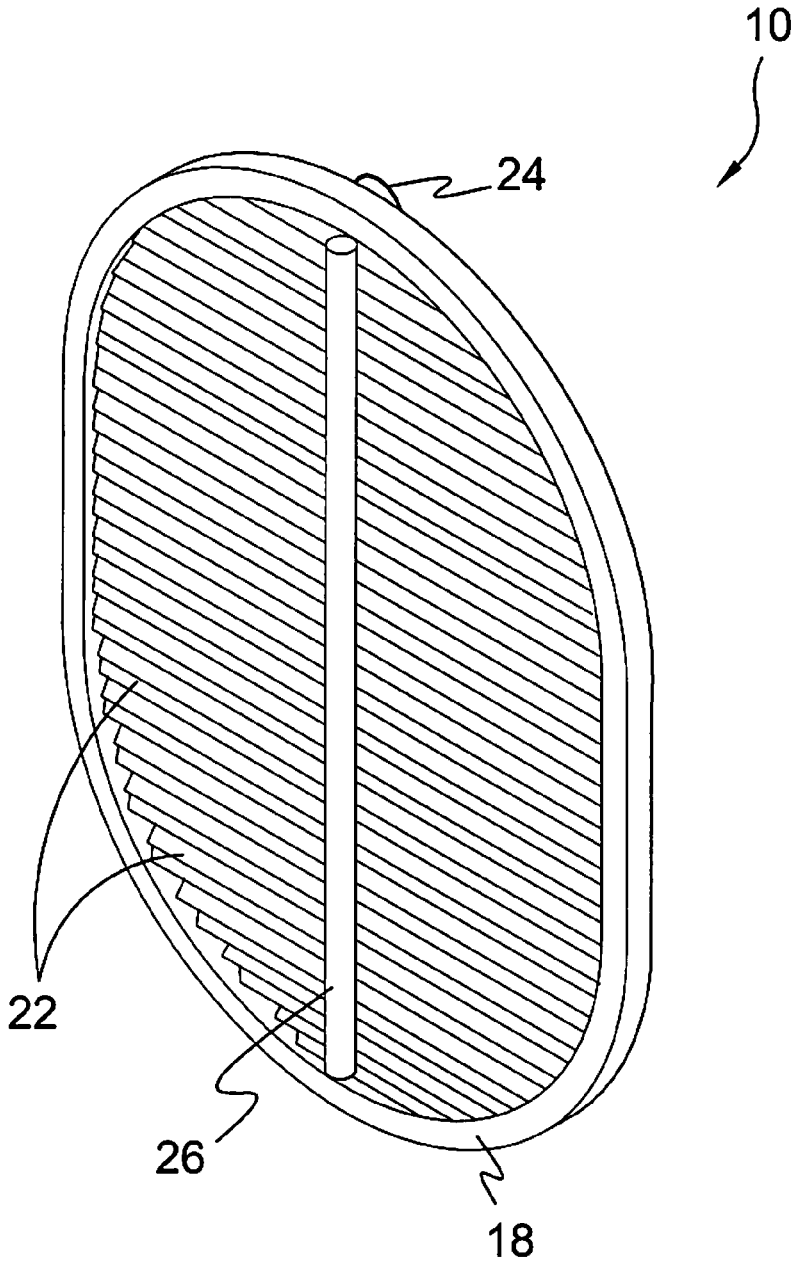
FIG. 3 is a perspective view of the portable operational privacy cover blind pressed on glass.

FIG. 3 is a perspective view of the portable privacy press on glass-cover blind 10. Shown is the privacy glass-cover blind 10 having a plurality of mini-slats 22 oriented in a horizontal position with an operating rod 26 whereby the blind-slats 22 can be moved between an open and closed position. The present invention 10 provides that the blind-slats 22 can be oriented in either a horizontal or vertical direction with the operating rod 26 extending transversally to the blind-slats. The mini-slats 22 are pivotally fixed within the frame 18 so that the slats 22 can be moved from a completely closed orientation to a completely open orientation or anywhere inbetween as desired. The portable glass-cover blind 10 is designed to be easily attached and detached from its mating engagement with the door-glass window. Also provided is a fabric slat version without an encompassing peripheral frame whereby with the inclusion of a cord the fabric slats can also be moved between an open and closed position.

Figure 4:
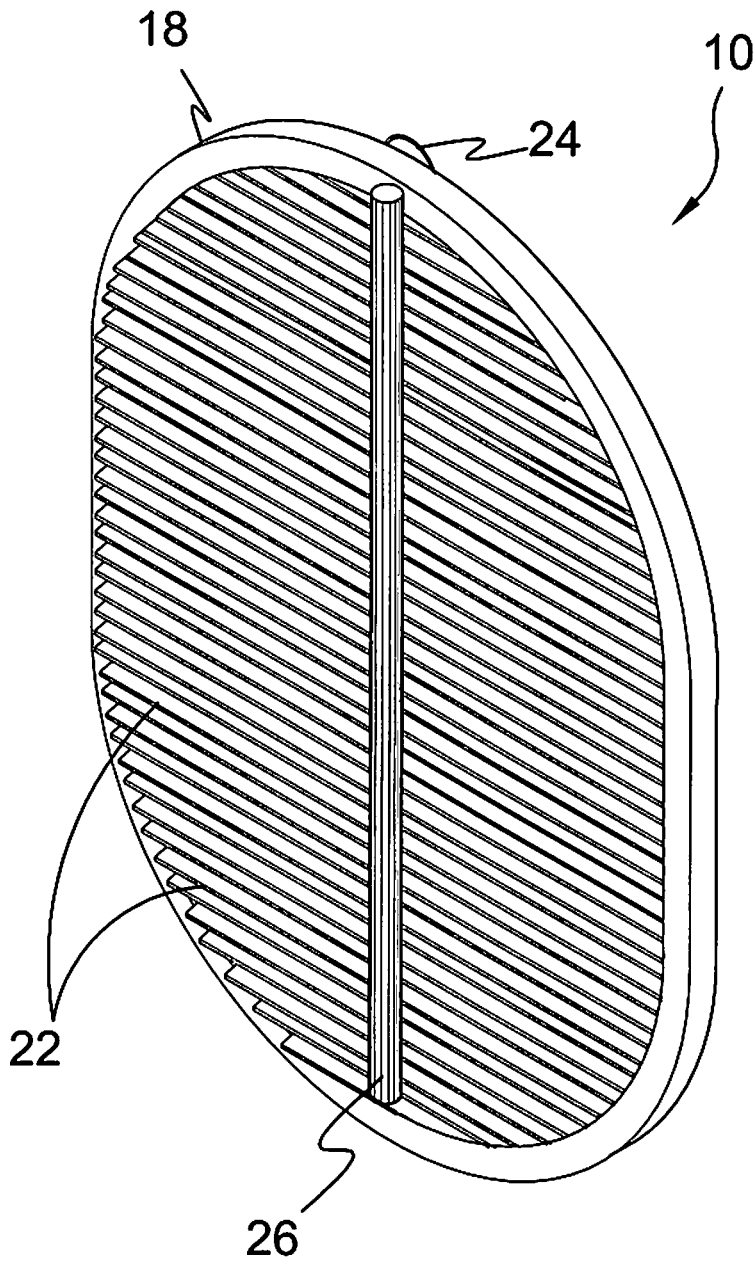
FIG. 4 is a perspective view of the privacy cover blind press on glass in an open position.

FIG. 4 is a perspective view of the portable glass-cover blind in an open position. Shown is the glass-cover blind 10 comprising a frame 18 having a plurality of pivotal slats 22 attached to an operating rod 26 for moving the slats 22 between an open and closed state. The orientation of the slats 22 can be either horizontal or vertical with the operating rod 26 fixed transversally to the slat 22 orientation. The present invention 10 provides fasteners 24 for releasably attaching the glass-cover blind 22 to the door-glass window 16 with the fasteners 24 taken from the group of suction cups, magnet, clips, two way tape or Velcro®.

Figure 5:
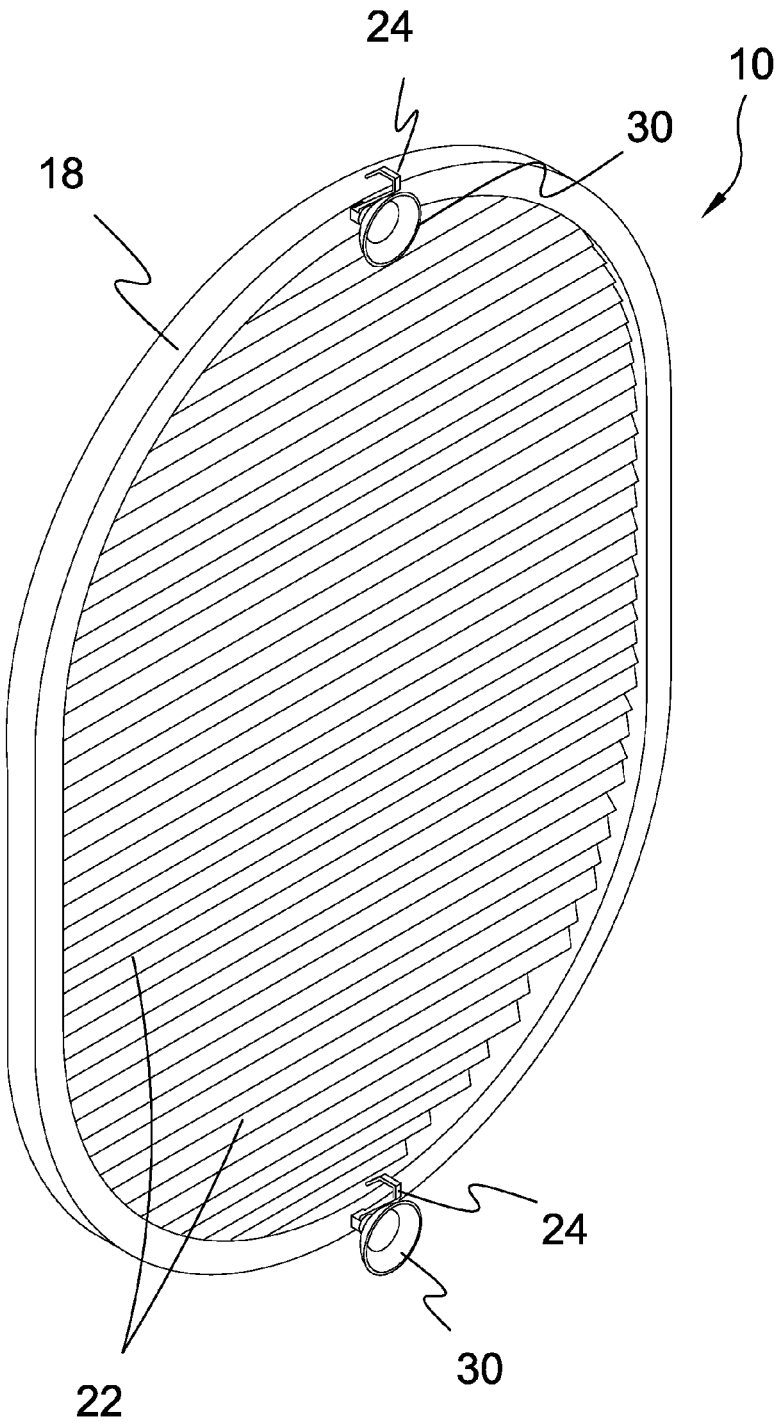
FIG. 5 is a perspective view of the mounting side of the glass-cover blind.

FIG. 5 is a perspective view of the mounting side of the glass-cover blind. The portable privacy glass-cover blind 10 has a frame 18 which substantially is pressed on glass and fits into the frame of an existing door-glass window. The portable privacy glass-cover blind 10 is mounted within the window frame using a fastener 24 taken from the group consisting of suction cups 30, magnets, Velcro® and clips. Once positioned and secured the privacy glass-cover blind 10 has a plurality of mini-slats 22 pivotally fastened to the frame 18 and movable through an operating rod. The present invention also provides for a fabric privacy glass-cover blind 10 without an encompassing frame whereby a length of cord can be used to gather the fabric glass-cover blind-slats 22 into an open position or released to a closed position.

Figure 6:
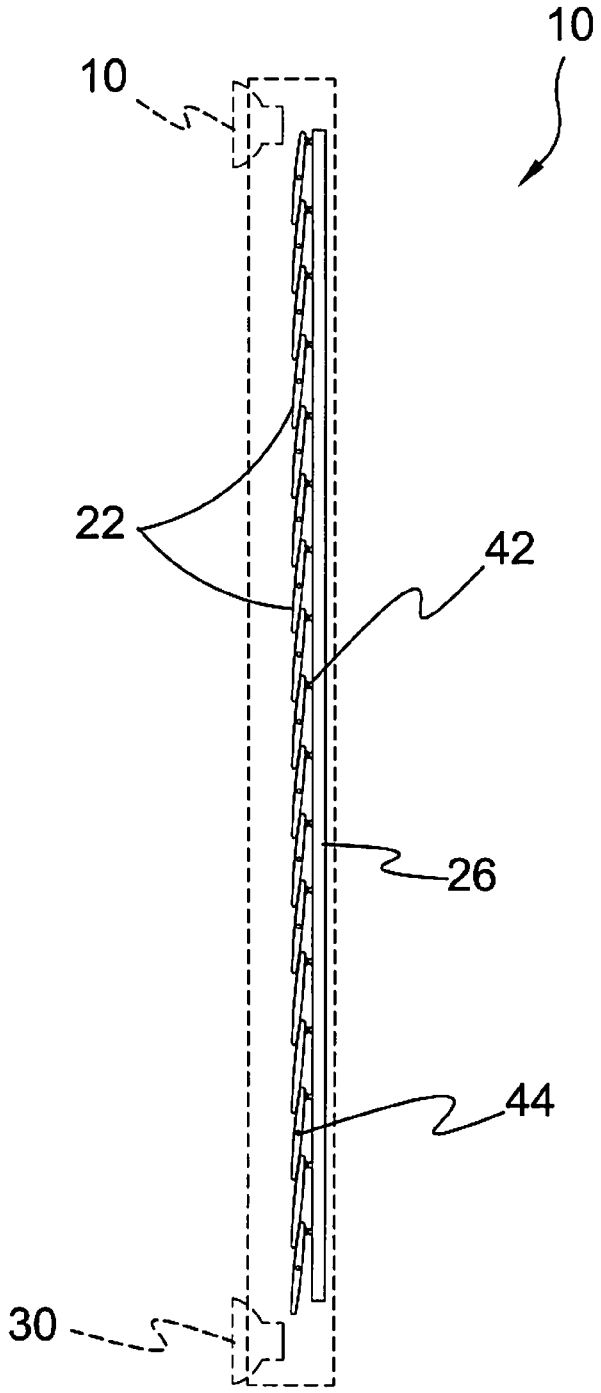
FIG. 6 is a side view of the portable privacy press on glass-cover blind in a closed position.

FIG. 6 is a side view of the portable privacy press on glass-cover blind in a closed position. Shown is the privacy glass-cover blind 10 in a slats 22 closed position creating a portable decorative element for the door-glass window that can be easily removed as desired making the privacy glass-cover blind very portable. An attachment means 42 is provided to connect the operating rod 26 to each slat 22 and a slat pivot 44 attached to the frame 18 is medially employed to allow for the rotation thereof.

Figure 7:
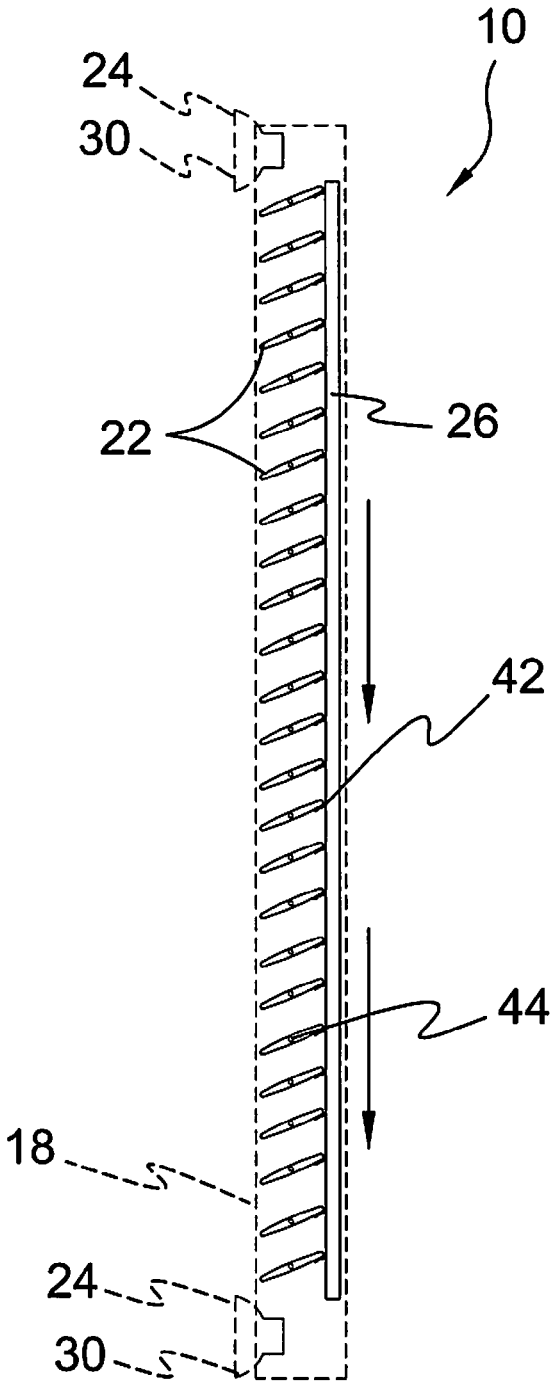
FIG. 7 is a side view of the operational portable press on glass-cover blind in an open position.

FIG. 7 is a side view of the privacy glass-cover blind in an open position. Shown is the privacy glass-cover blind 10 having a plurality of mini-slats 22 oriented in an open position with an operating rod 26 whereby the glass-cover blind-slats 22 can be moved between an open and closed position as desired. The privacy glass-cover blind 10 is designed with mini-slats 22 so that the glass-cover blind-slats 22 or operating rod 26 do not extend beyond the privacy glass-cover blind frame 18. The present invention 10 provides that the privacy glass-cover blind-slats 22 can be oriented in either a horizontal or vertical direction with the operating rod 26 extending transversally to the glass-cover blind-slats 22. The mini-slats 22 are pivotally fixed within the frame 18 so that the slats 22 can be moved from a completely closed orientation to a completely open orientation or anywhere inbetween as desired. The portable privacy screen is designed to be easily attached and detached from its mating engagement with the door window using a fastener 24 taken from the group consisting of suction cups, magnets, clips, two way tape and Velcro® material. An attachment means 42 is provided to connect the operating rod 26 to each slat 22 and a slat pivot 44 attached to the frame 18 is medially employed to allow for the rotation thereof.

Figure 8:
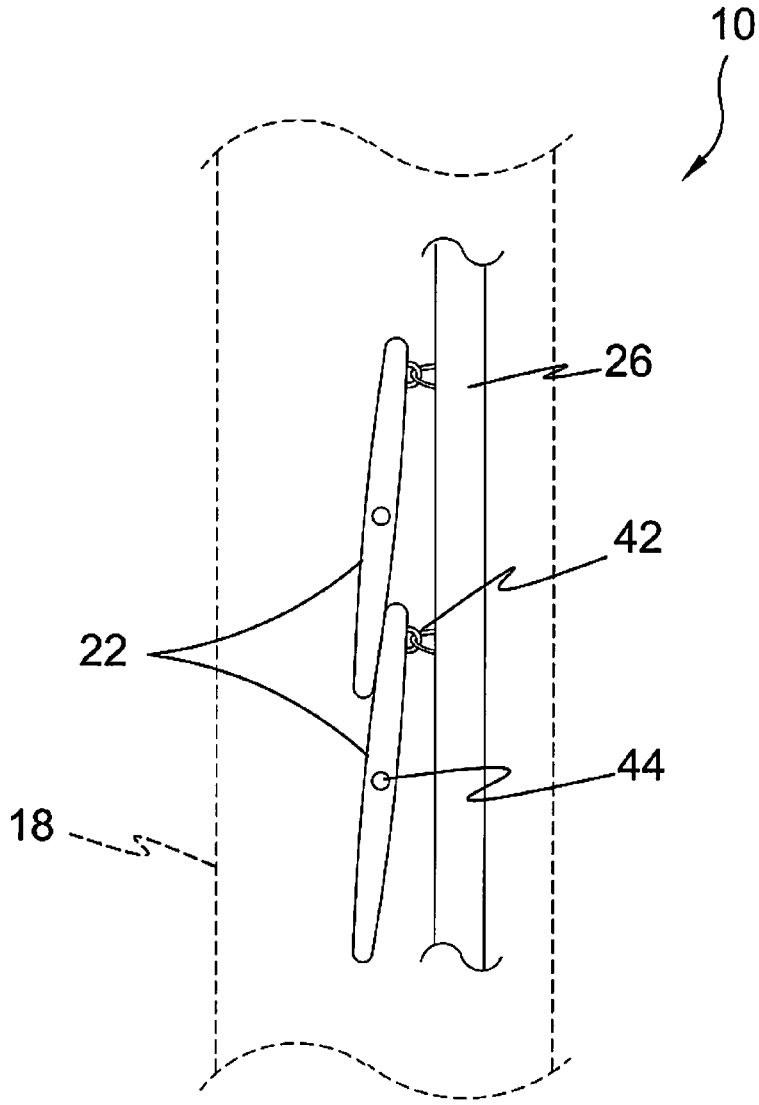
FIG. 8 is an enlarged partial view of the blind mini-slats in a closed position.

FIG. 8 is an enlarged partial view of the mini-slats in a closed position. Shown is the present invention 10 with blind-slats 22 in a closed position and housed within a frame 18 having a centrally located operating rod 26 for adjustment of the blind-slats 22 from a closed to an open position. The device provides releasable fasteners, such as suction cups to secure it to a door-window.

Figure 9:
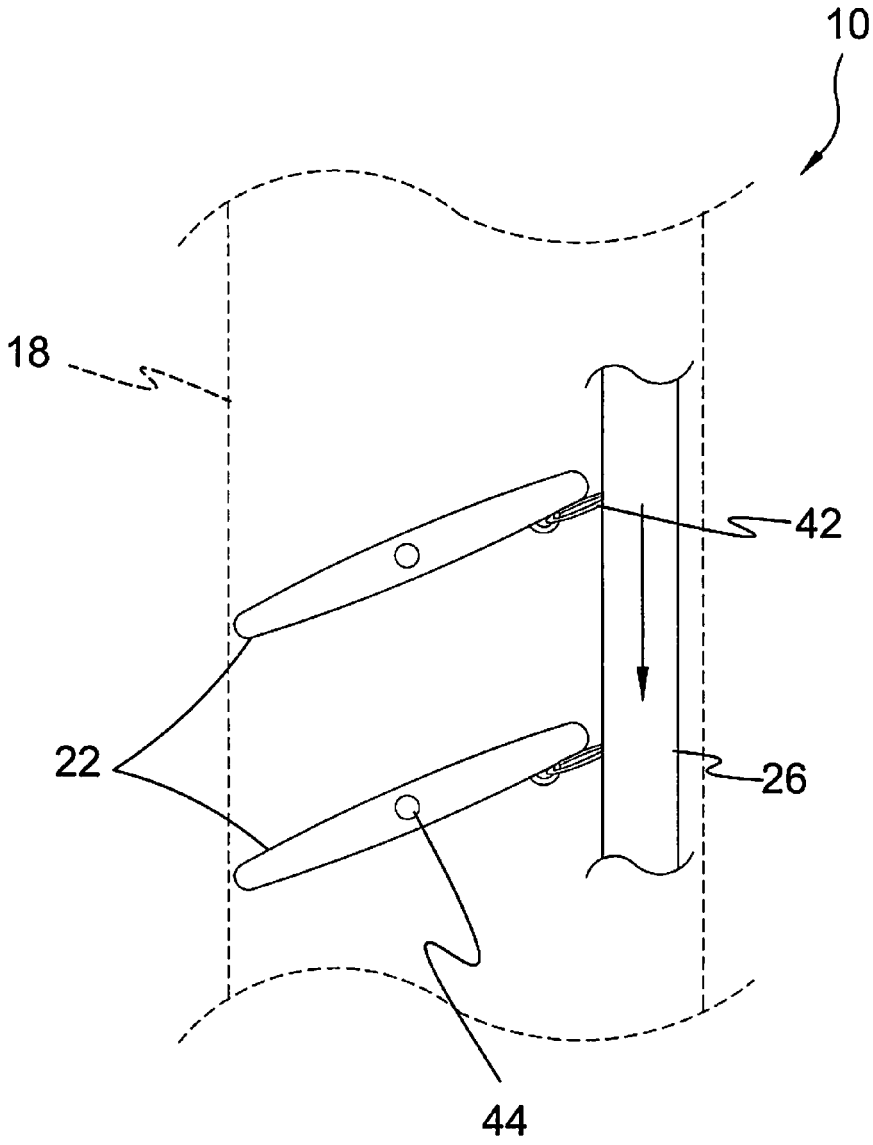
FIG. 9 is a detailed view of the present invention in an open position.

FIG. 9 is a detailed view of the present invention in an open position. Shown is the present invention 10 with glass-cover blind-slats 22 in an open position and housed within a frame 18 having a centrally located slide bar 26 for adjustment of the blind-slats 22 from a closed to an open position. The glass-cover blind has a group of chosen fasteners either suction cups, double faced tape, clips, Velcro® and magnets whereby the glass-cover blind can be dismounted as desired for maintenance, painting, cleaning, re-positioning, etc.

Figure 10:
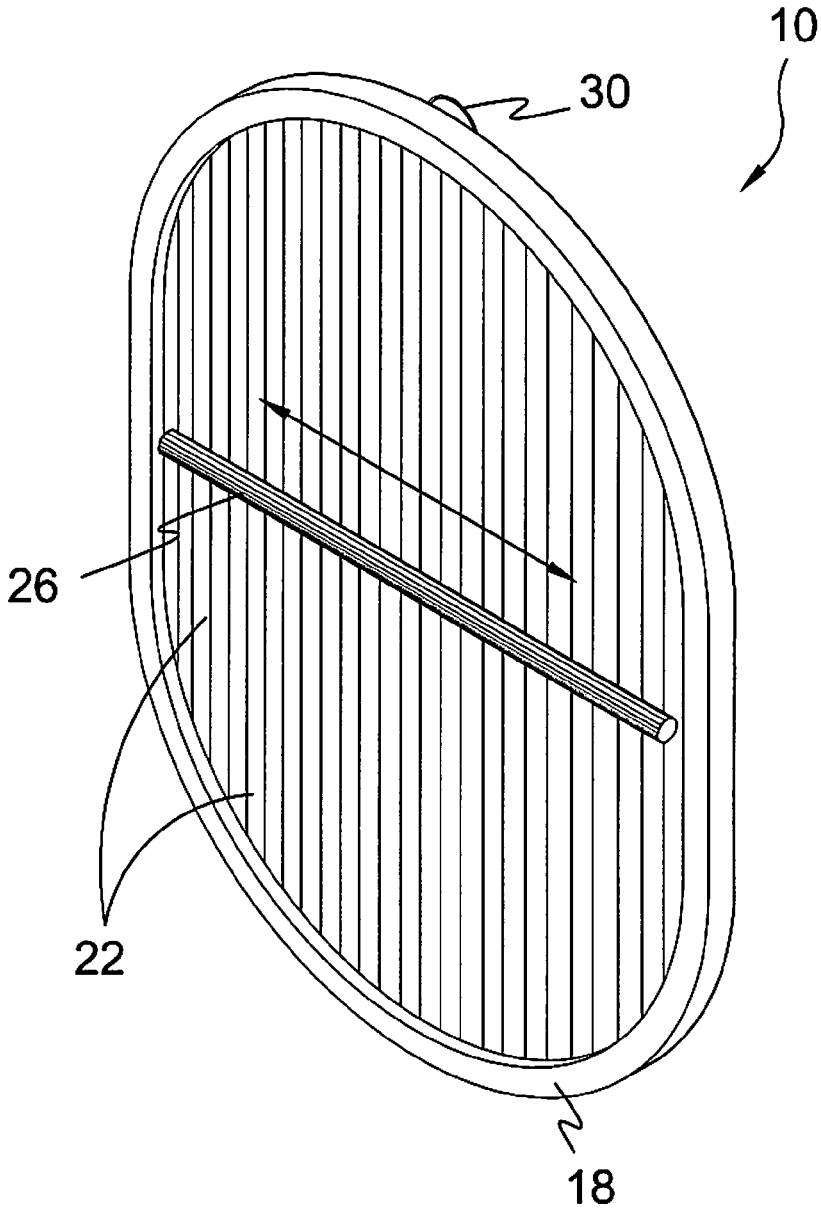
FIG. 10 is an alternate orientation of the mini-slats within the door-glass blind.

FIG. 10 is an alternate orientation of the mini-slats within the door-glass blind. Shown is the vertical door-glass blind 10 of the present invention housed within a frame 18 having adjustable blind-slats 22 that pivot on axis points and are controlled by an adjustment bar or control handle 26 allowing for a side to side position to be achieved. The device provides suction cups 30 to secure it to any shaped door-glass window or window.

Figure 11:
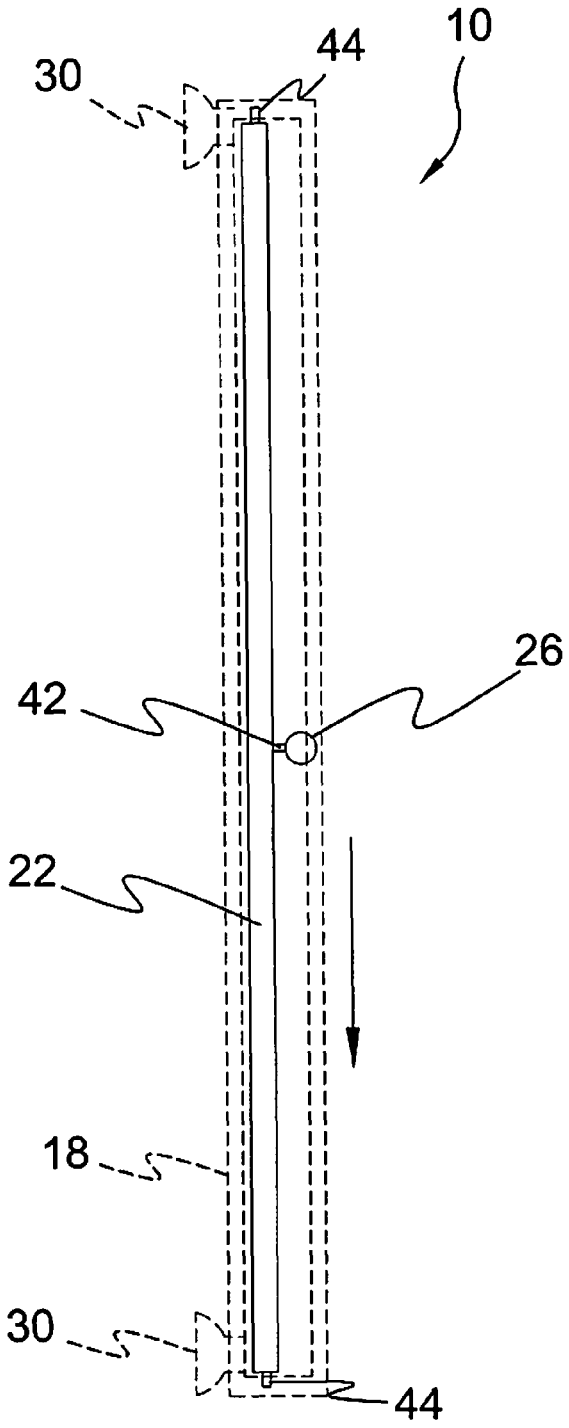
FIG. 11 is a sectional view of the vertically oriented privacy glass-cover blind-slats.

FIG. 11 is a sectional view of the vertically oriented privacy glass-cover blind-slats. Shown is a sectional view of the vertical slats 22 of the present invention housed within a frame 18 having adjustable blind-slats. An attachment means 42 is provided to connect the operating rod 26 to each slat 22 and a slat pivot 44 attached to the frame 18 is medially employed to allow for the rotation thereof. The shutter slats 22 are made of a light weight material. The device provides suction cups 30 to secure it to an any shaped glass door or window. Other options or means for attaching the device of the present invention are suction cups with magnets, Velcro®, double sided tape or clips.

Figure 12:
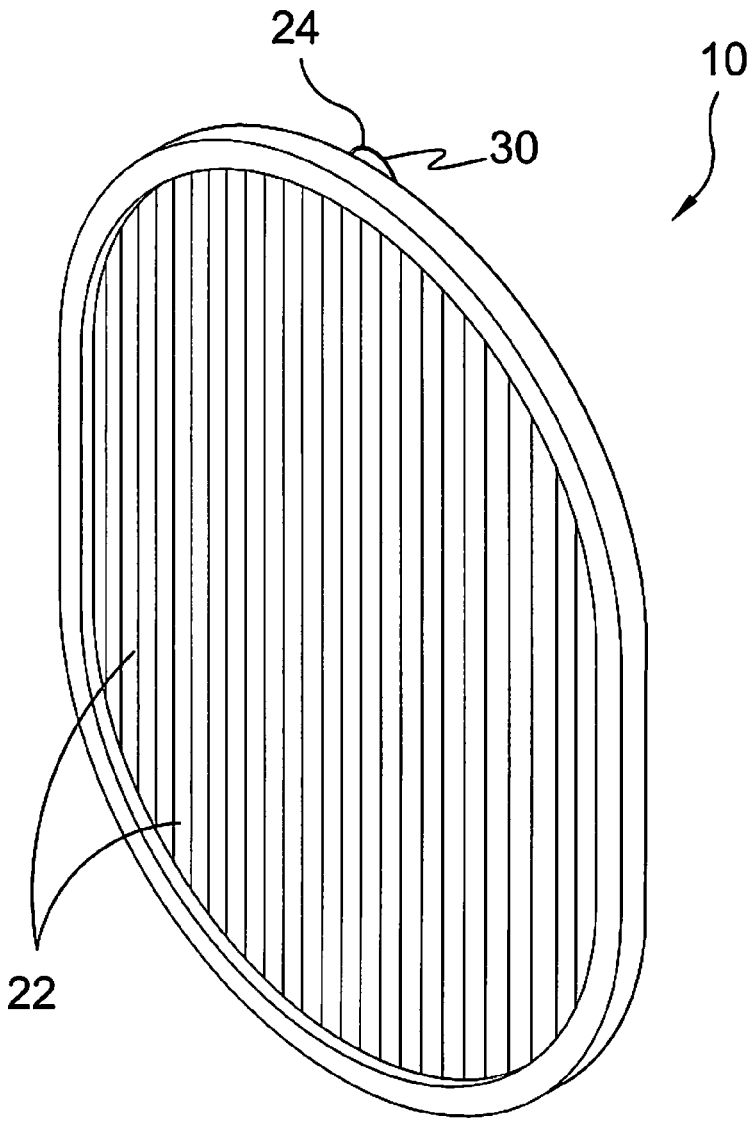
FIG. 12 is an alternate glass-cover blind of the present invention.
Figure 13:
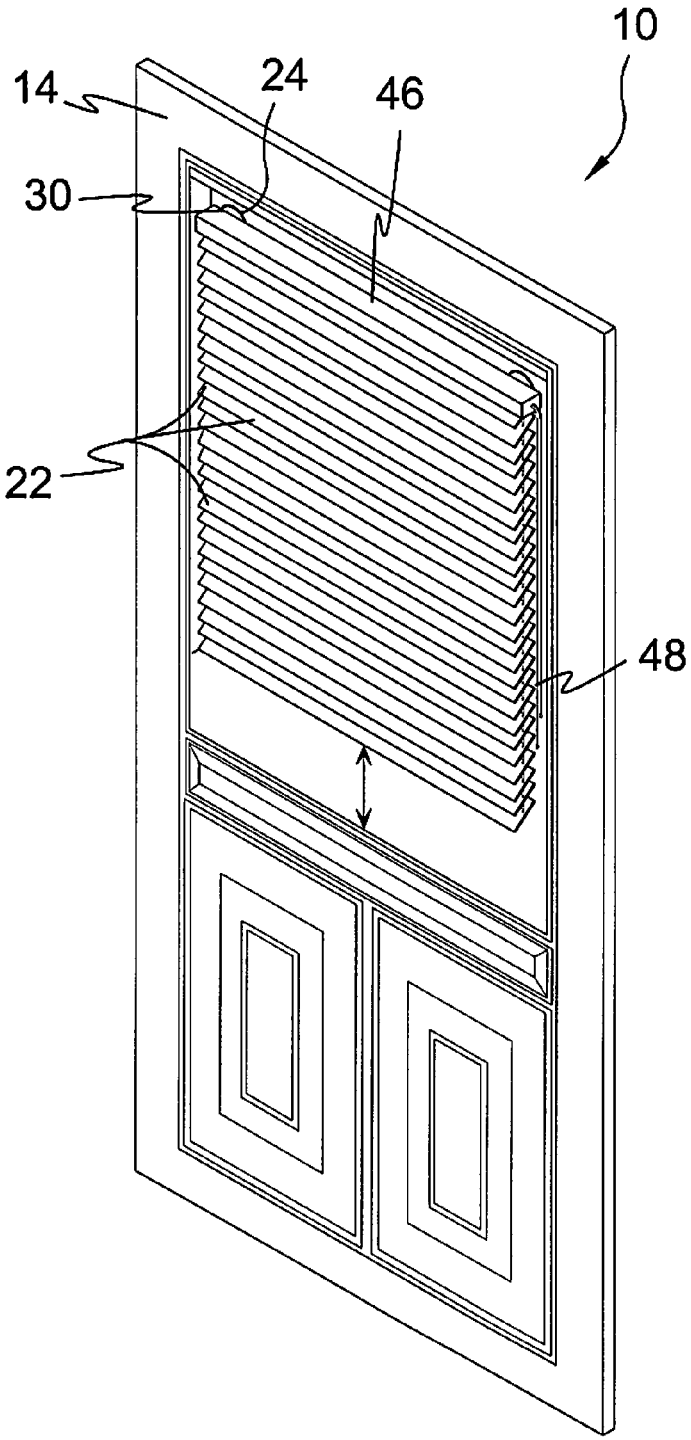
FIG. 13 is an alternate door-glass window shape of the present invention.

FIG. 12 is an alternate glass-cover blind of the present invention. Shown is the vertical glass-cover blind 10 of the present invention having stationary blind-slats 22. The blind-slats 22 are made of a light weight material. The device provides suction cups 30 or other fasteners 24 to secure it to any shaped glass door or window. Other options or means for attaching the door-glass blind of the present invention are suction cups with magnets, Velcro®, double sided tape or clips FIG. 13 is an alternate door-glass window shape of the present invention. Shown is the horizontal shutters of the present invention mounted to any shaped glass door. Means of attachment could be suction cup, magnet, double sided tape, clips or Velcro®.

Figure 14:
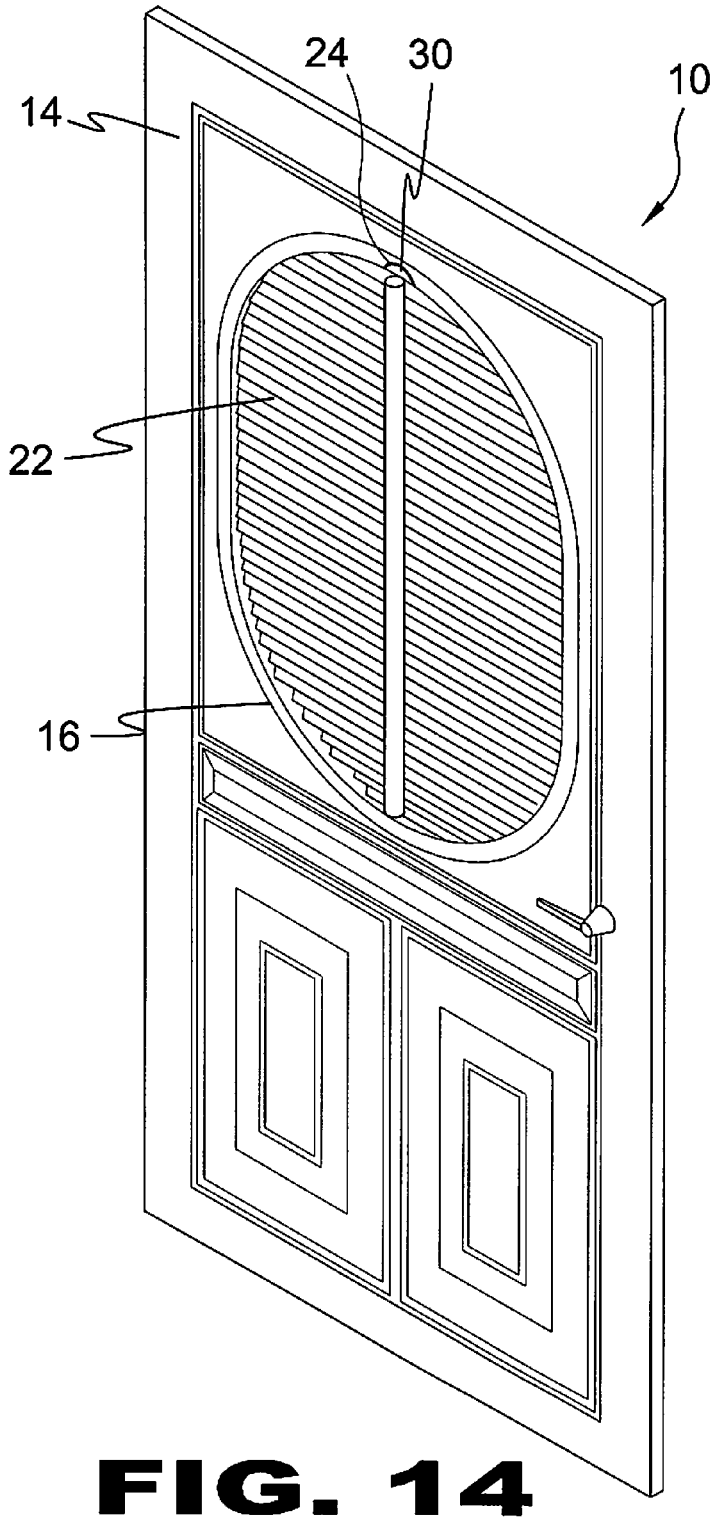
FIG. 14 is an alternate door-glass window shape of the present invention.

FIG. 14 is an alternate door-glass window shape of the present invention. Shown is the horizontal blind-slats of the present invention mounted to an oval shaped glass door. Means of attachment could be suction cup, magnet, double sided tape, Velcro® or clips.

Figure 15:
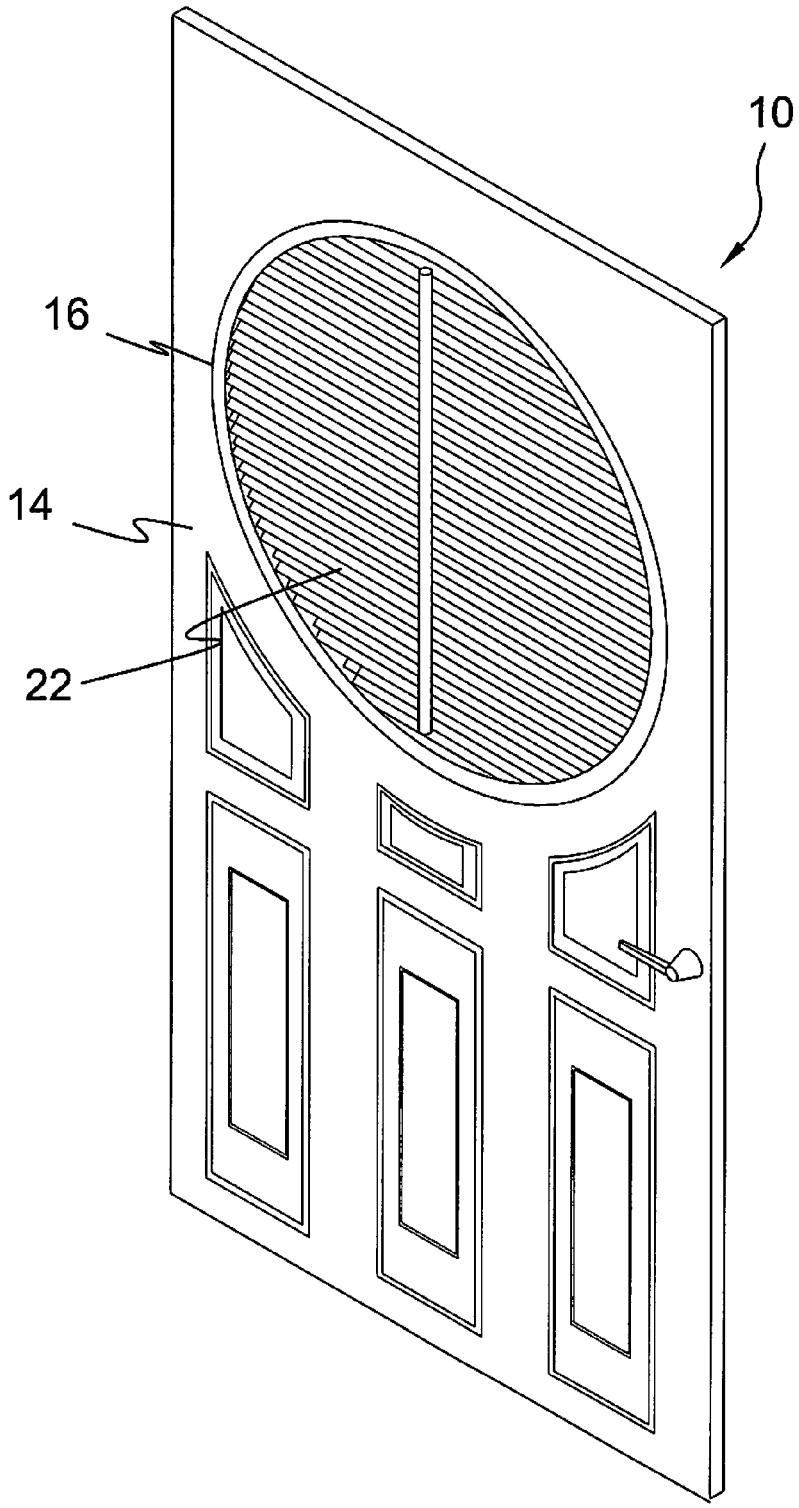
FIG. 15 is an alternate door-glass window shape of the present invention.

FIG. 15 is an alternate door-glass window shape of the present invention. Shown is the horizontal door-glass blind of the present invention mounted to a door having a glass with an elliptical shape.

Figure 16:
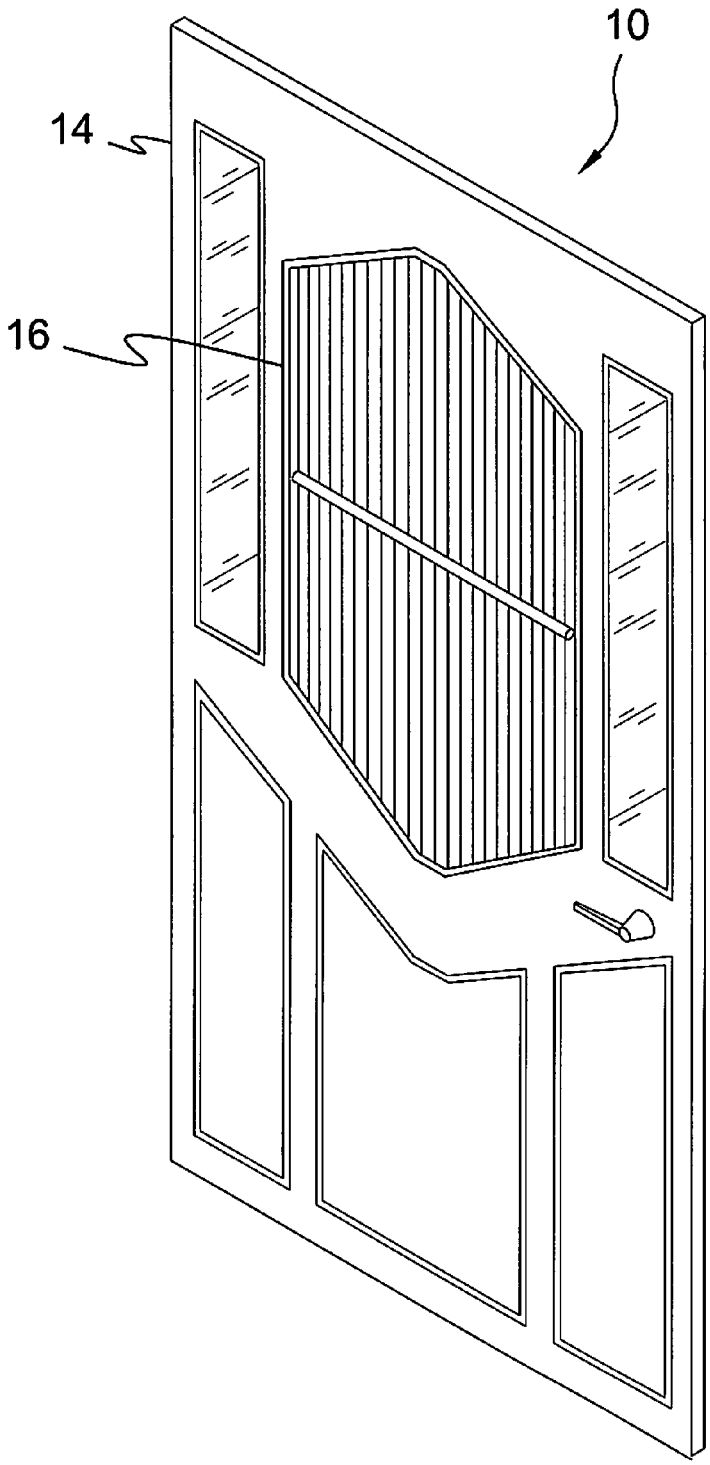
FIG. 16 is an alternate door-glass window shape of the present invention.

FIG. 16 is an alternate door-glass window shape of the present invention. Shown is the vertical door-glass blind of the present invention mounted to a door-glass window having an elliptical shape.

Figure 17:
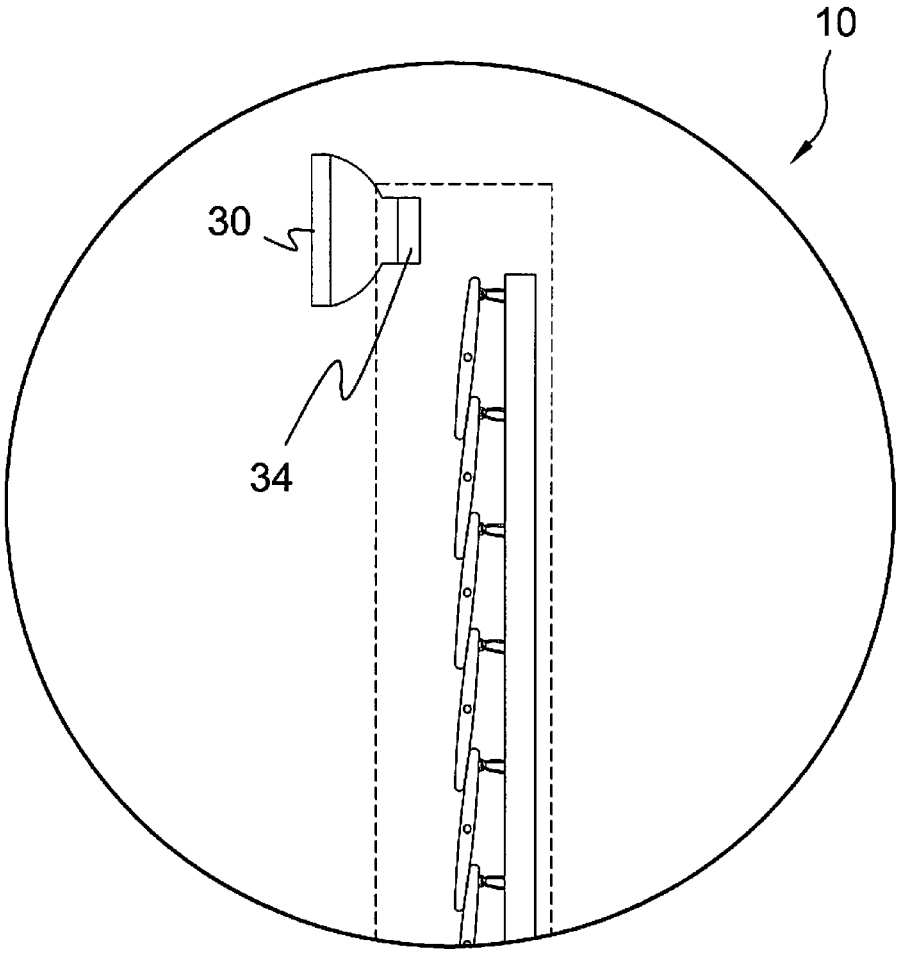
FIG. 17 is an alternate means of attachment of the door-glass blind.

FIG. 17 is an alternate means of attachment of the door-glass blind. Shown is an alternate means of attaching the present invention 10 to a window or a door comprising a suction cup 30 and magnet 34.

Figure 18:
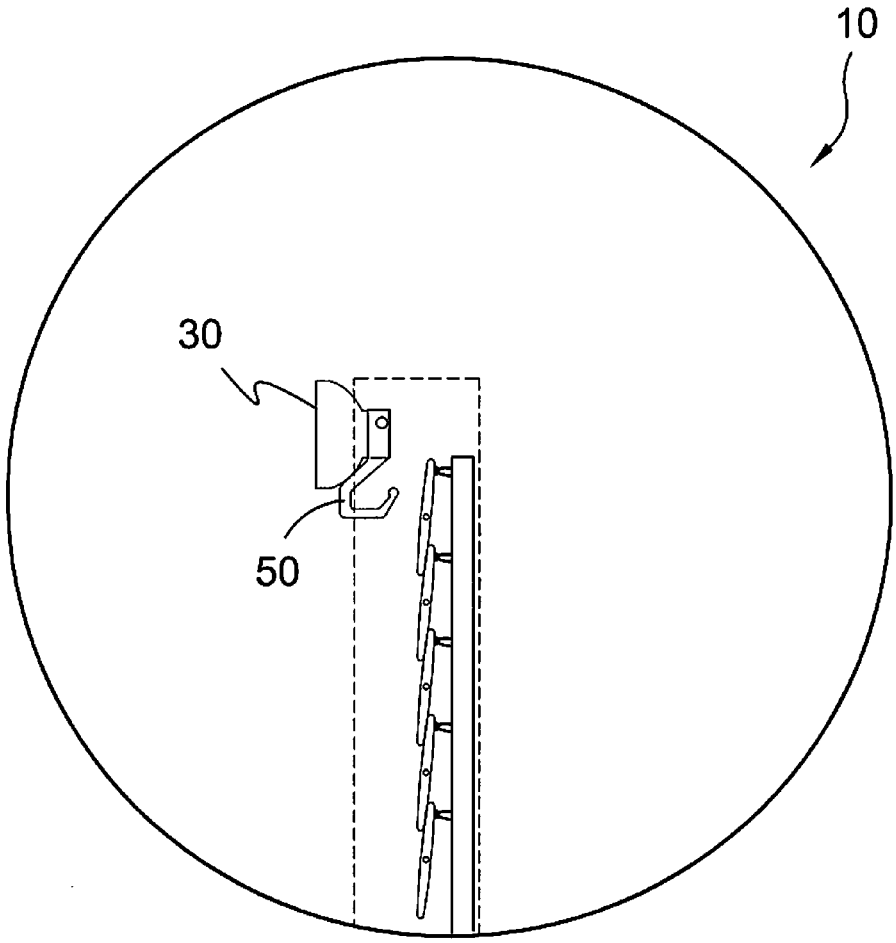
FIG. 18 is an alternate means of attachment of the door-glass blind.

FIG. 18 is an alternate means of attachment of the door-glass blind. Shown is an alternate means of attaching the present invention 10 to a window or a door comprising a suction cup 30 with a handle 50 that pivots to attach and release suction.

Figure 19:
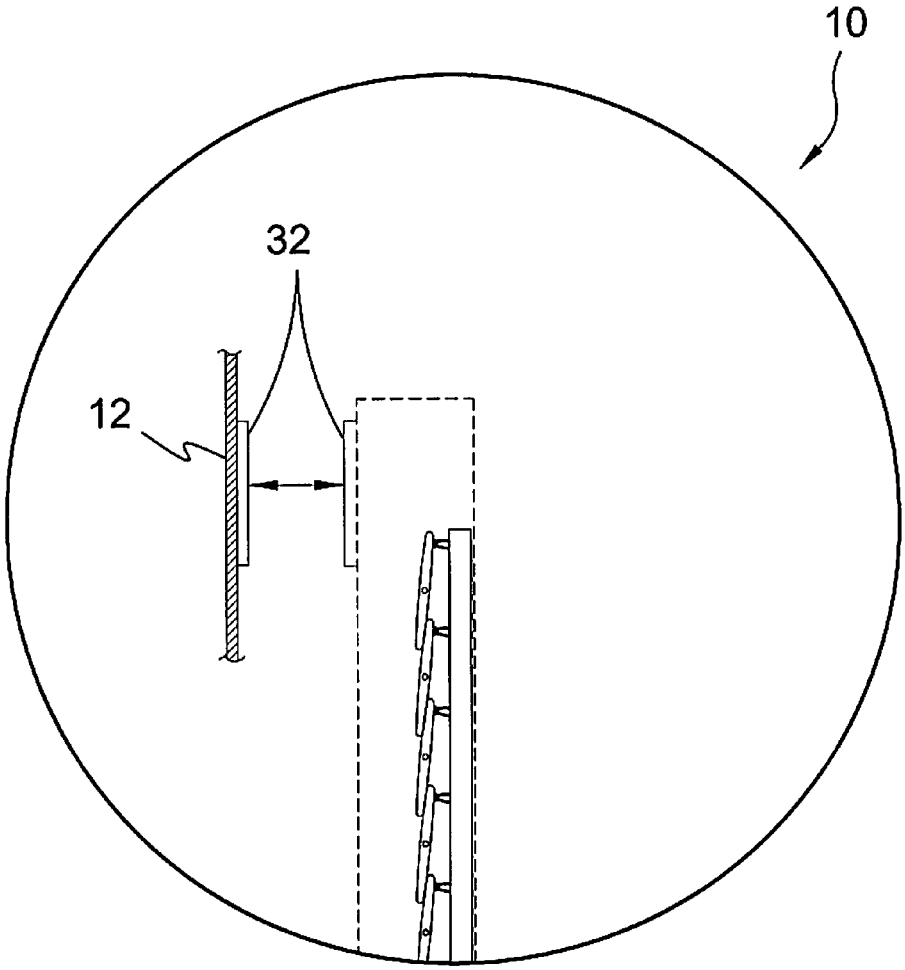
FIG. 19 is an alternate means of attachment of the door-glass blind.

FIG. 19 is an alternate means of attachment of the door-glass blind. Shown is an alternate means of attaching the present invention 10 to the glass 12 of a window or a door comprising Velcro® counter parts 32.

Figure 20:
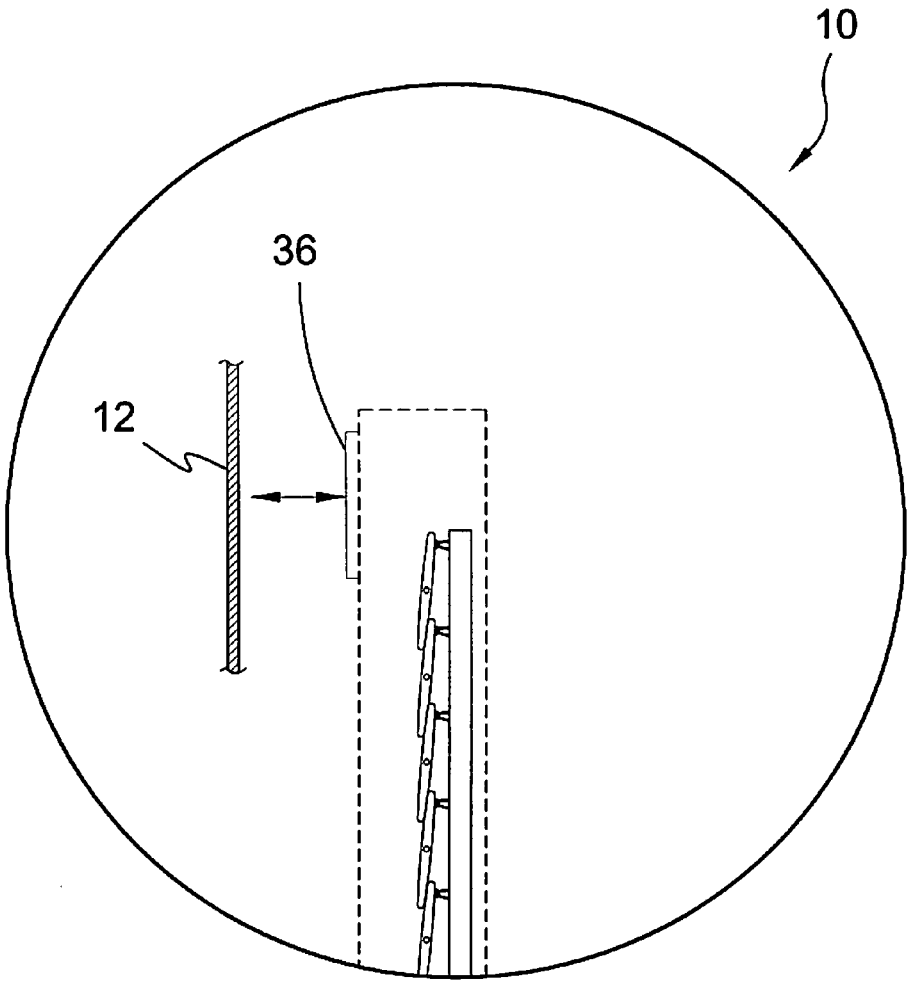
FIG. 20 is an alternate means of attachment of the door-glass blind.

FIG. 20 is an alternate means of attachment of the door-glass blind. Shown is an alternate means of attaching the present invention 10 to the glass 12 of a window or a door comprising double sided tape 36.

Figure 21:
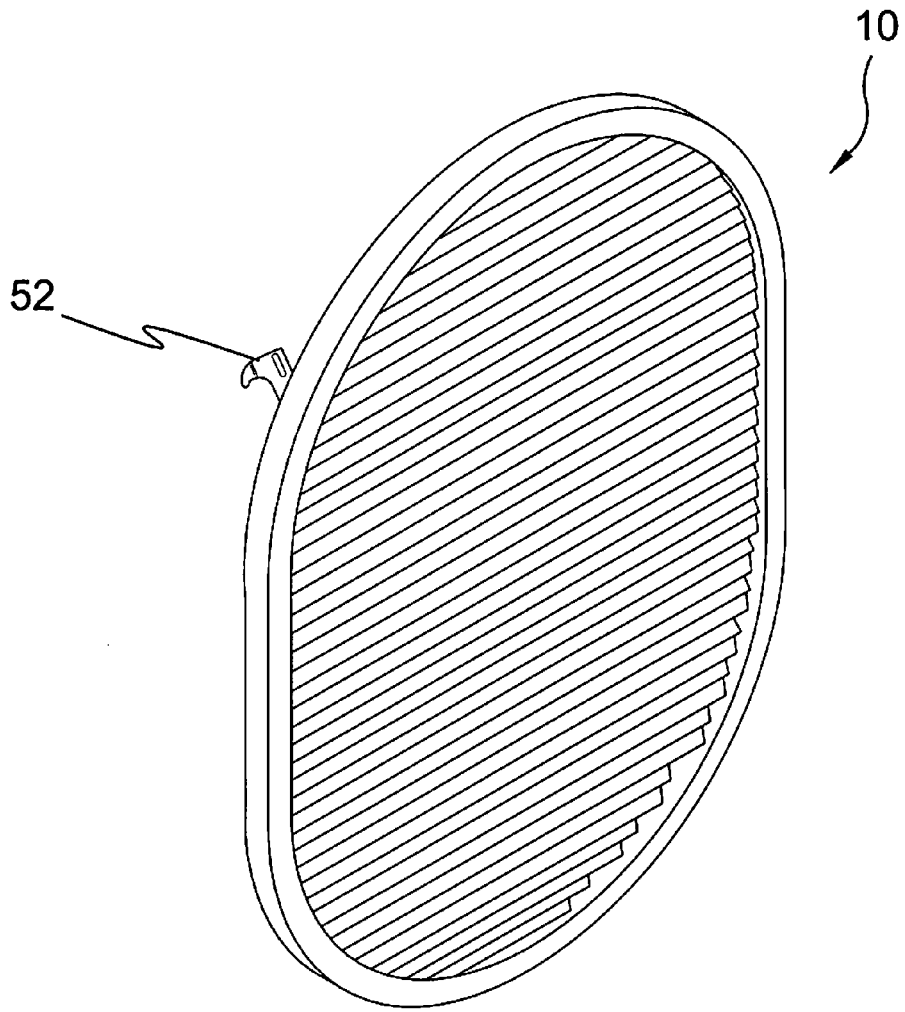
FIG. 21 is an alternate means of attachment of the door-glass blind.

FIG. 21 is an alternate means of attachment of the door-glass blind. Shown is an alternate means of attaching the present invention 10 to the glass 12 of a window or a door comprising clips 52.

Figure 22:
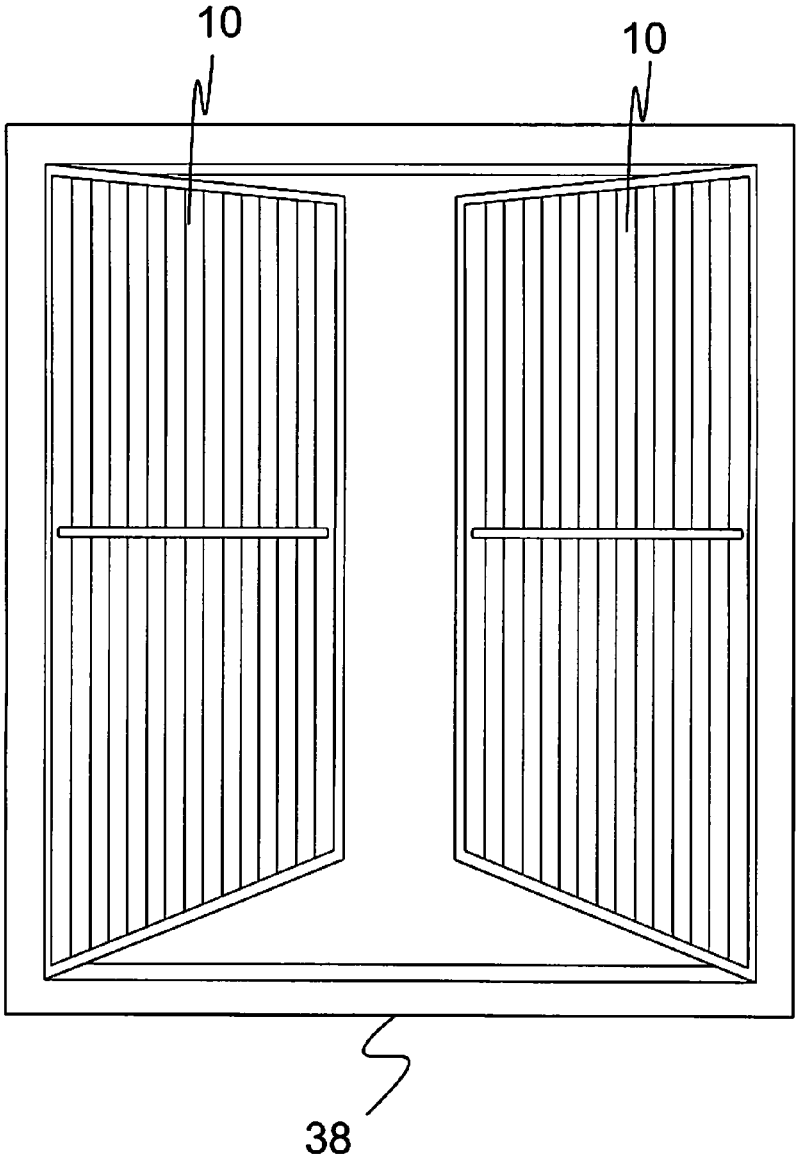
FIG. 22 is an alternate window-glass style having the present invention applied.

FIG. 22 is an alternate window-glass style having the present invention applied. Shown is a casement window 38 having the portable operational privacy door-glass blind 10 of the present invention applied thereto. Means of attachment could be suction cup, magnet, double sided tape, clips or Velcro®.

Figure 23:
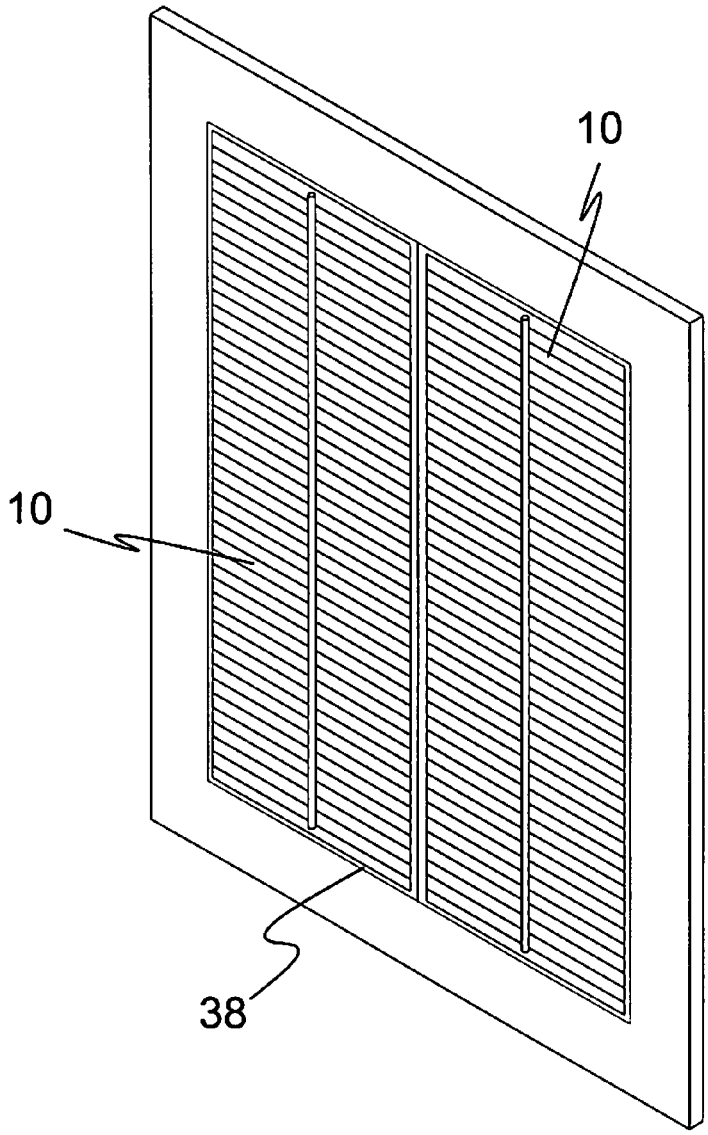
FIG. 23 is an alternate press on privacy window-glass style having the present invention applied.

FIG. 23 is an alternate press on privacy window-glass style having the present invention applied. Shown is a casement window 38 having the door-glass blinds of the present invention 10 applied thereto. Means of attachment could be suction cup, magnet, double sided tape, clips or Velcro®.

Figure 24:
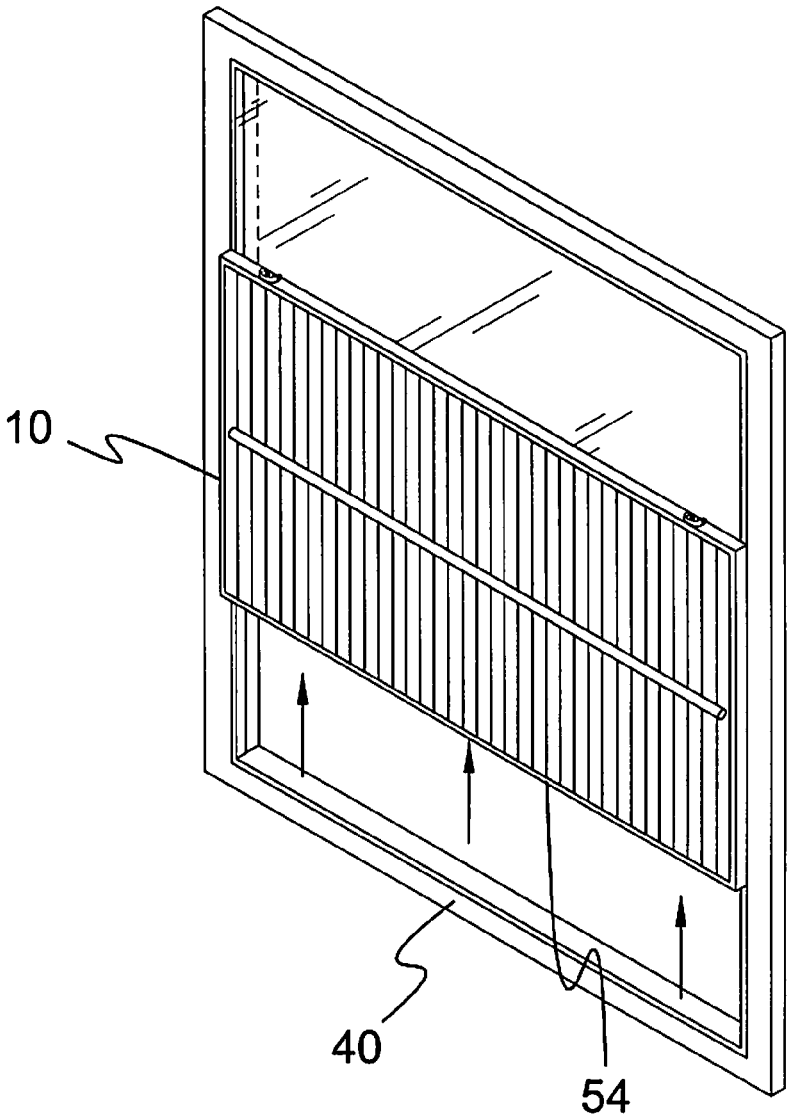
FIG. 24 is an alternate window-glass style having the present invention applied.

FIG. 24 is an alternate window-glass style having the present invention applied. Shown is a double hung window 40 with the bottom window 54 open having the privacy door-glass blind 10 of the present invention applied thereto. Means of attachment could be suction cup, magnet, double sided tap or clips or Velcro®.

Figure 25:
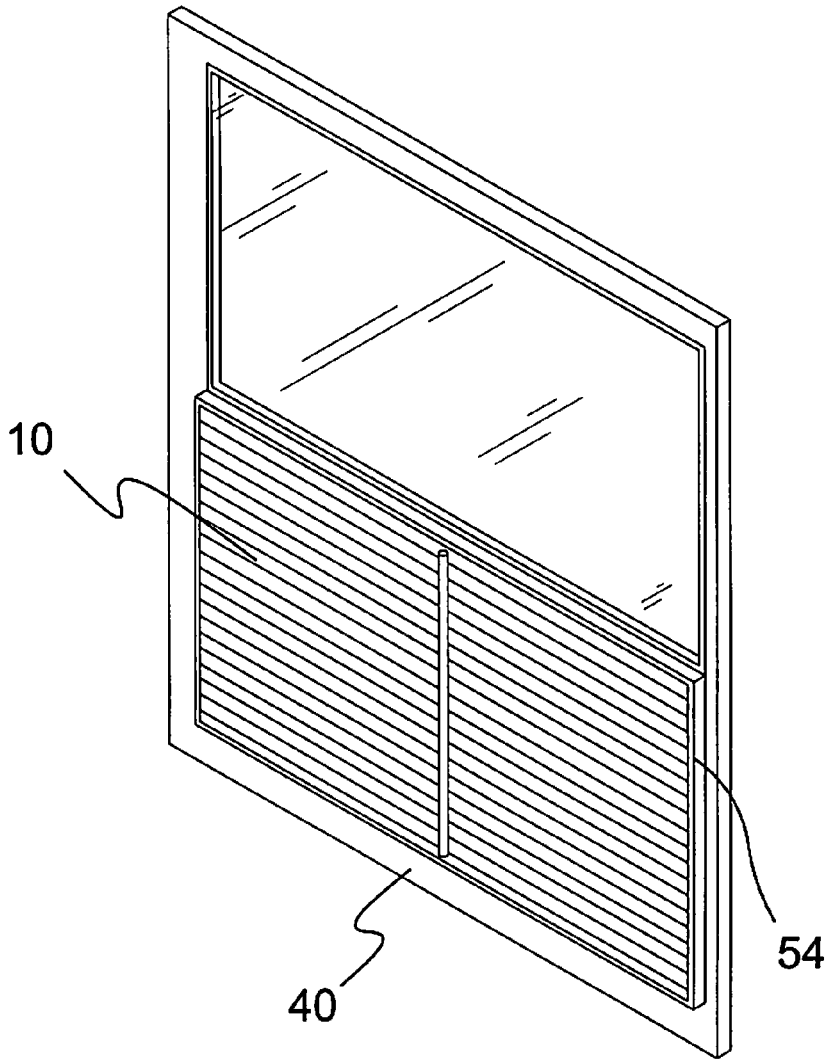
FIG. 25 is an alternate window-glass style having the present invention applied.

FIG. 25 is an alternate window-glass style having the present invention applied. Shown is a double hung window 40 with the bottom window 54 closed having the door-glass blinds of the present invention 10 applied thereto. Means of attachment could be suction cup, magnet, double sided tap or clips or Velcro®.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

The invention claimed is:

1. A combination of a portable, releasable glass cover blind and one of a framed glass door or a framed glass window, the glass cover blind is a single independent unit removably installed to the one of the framed glass door or the framed glass window in order to allow a rapid and simple installation; the combination consisting of:

a) the one of said framed door or said framed window enclosing a sheet of glass;

b) a portable oval frame enclosing and supporting a plurality of elongated slats, said slats are longitudinally parallel with and adjacent to one another in an overlapping fashion, said slats vary in length with respect to one another in order to correspond to a varying width of the portable oval frame so that each of said slats respectively extends a full width of said portable oval frame, said portable oval frame fully encompassing and surrounding each of said plurality of slats;

c) a least one releasable suction cup directly and removably secured on said portable oval frame, the at least one suction cup being directly and removably secured to the sheet of glass;

d) each of said slats respectively are directly and pivotally attached to said portable oval frame at a respective center pivot axis of each said slat;

e) said plurality of slats respectively have an attachment directly attached to a major length of an operating rod that is in transverse relation to a major length of each respective slat so that a movement of said operating rod along the major length of the operating rod controls a pivoting motion of said slats in series with one another while maintaining a uniform spacing of the slats with respect to one another; the attachments are secured to said slats respectively between the central pivot axis and a terminal end of each respective slat.

2. The portable, releasable glass cover blind recited in claim 1, wherein said portable frame and said slats are sized and shaped to substantially conform to said sheet of glass.

3. The portable, releasable glass cover blind recited in claim 2, wherein said slats are horizontally oriented.

* * * * *